United States Patent [19]

Fink

[11] 4,035,024

[45] July 12, 1977

[54] HARD ROCK TRENCH CUTTING MACHINE

[75] Inventor: Trevor Fink, University Heights, Ohio

[73] Assignee: Jarva, Inc., Solon, Ohio

[21] Appl. No.: 640,690

[22] Filed: Dec. 15, 1975

[51] Int. Cl.[2] ..... E21D 9/10

[52] U.S. Cl. ..... 299/31; 37/96; 175/91; 299/86

[58] Field of Search ..... 299/31, 33, 64; 175/91; 37/94–96

[56] References Cited

U.S. PATENT DOCUMENTS

| | | | |
|---|---|---|---|
| 1,000,959 | 8/1911 | Beissel | 175/91 X |
| 1,314,011 | 8/1919 | Morgan | 299/33 X |
| 3,647,263 | 3/1972 | Lauber et al. | 299/31 |
| 3,765,725 | 10/1973 | Taylor | 299/33 X |

*Primary Examiner*—Ernest R. Purser

*Attorney, Agent, or Firm*—McNenny, Pearne, Gordon, Gail, Dickinson & Schiller

[57] ABSTRACT

A hard rock trench cutting machine includes a main body assembly, a cutter wheel assembly, and a longitudinal thrust assembly. The main body assembly includes two longitudinally extending cantilever support booms each having a forward portion and a rearward portion. The rearward portions of the support booms are connected to four side wall support feet which move laterally relative to the support booms between a retracted position and an extended position. The cutter wheel assembly includes a cutter wheel frame slidably disposed on the forward portion of the support booms. A cutter wheel drum carrying a plurality of roller cutters is rotatably carried by the cutter wheel frame for rotation about an axis. The longitudinal thrust assembly extends between the main body assembly and the cutter wheel assembly for pushing the roller cutters against the trench end face.

24 Claims, 21 Drawing Figures

Fig. 10
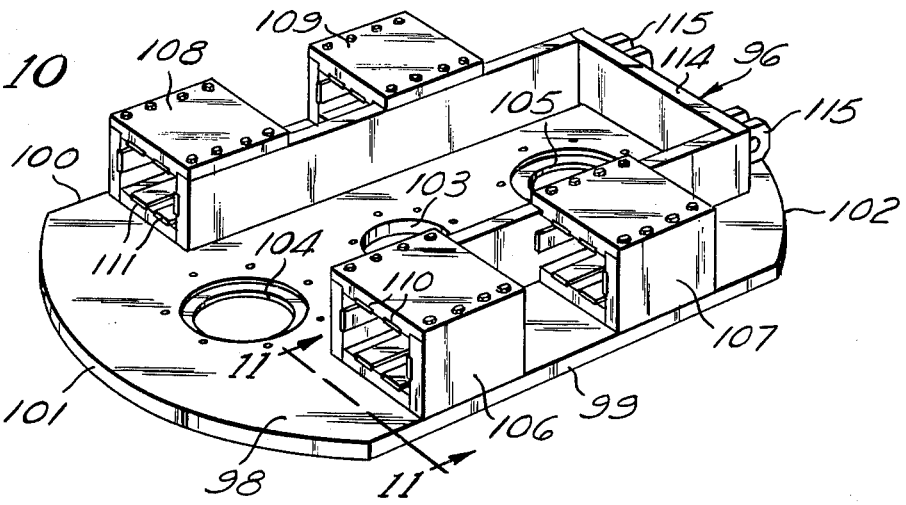
Fig. 11
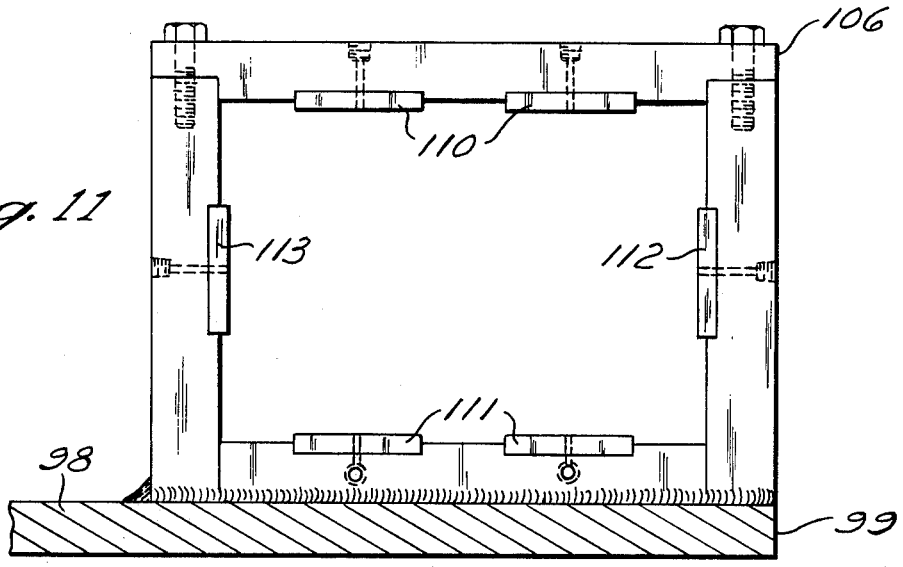
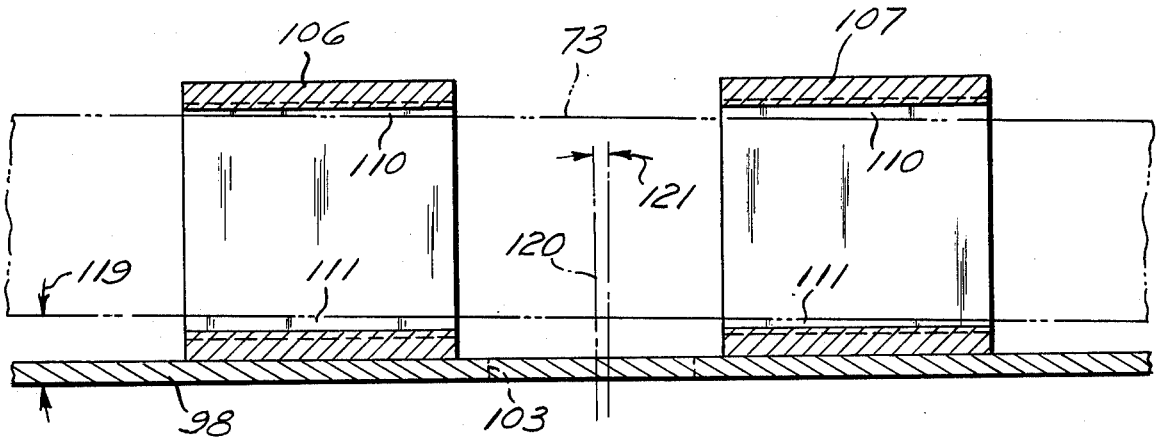
Fig. 12

Fig. 13
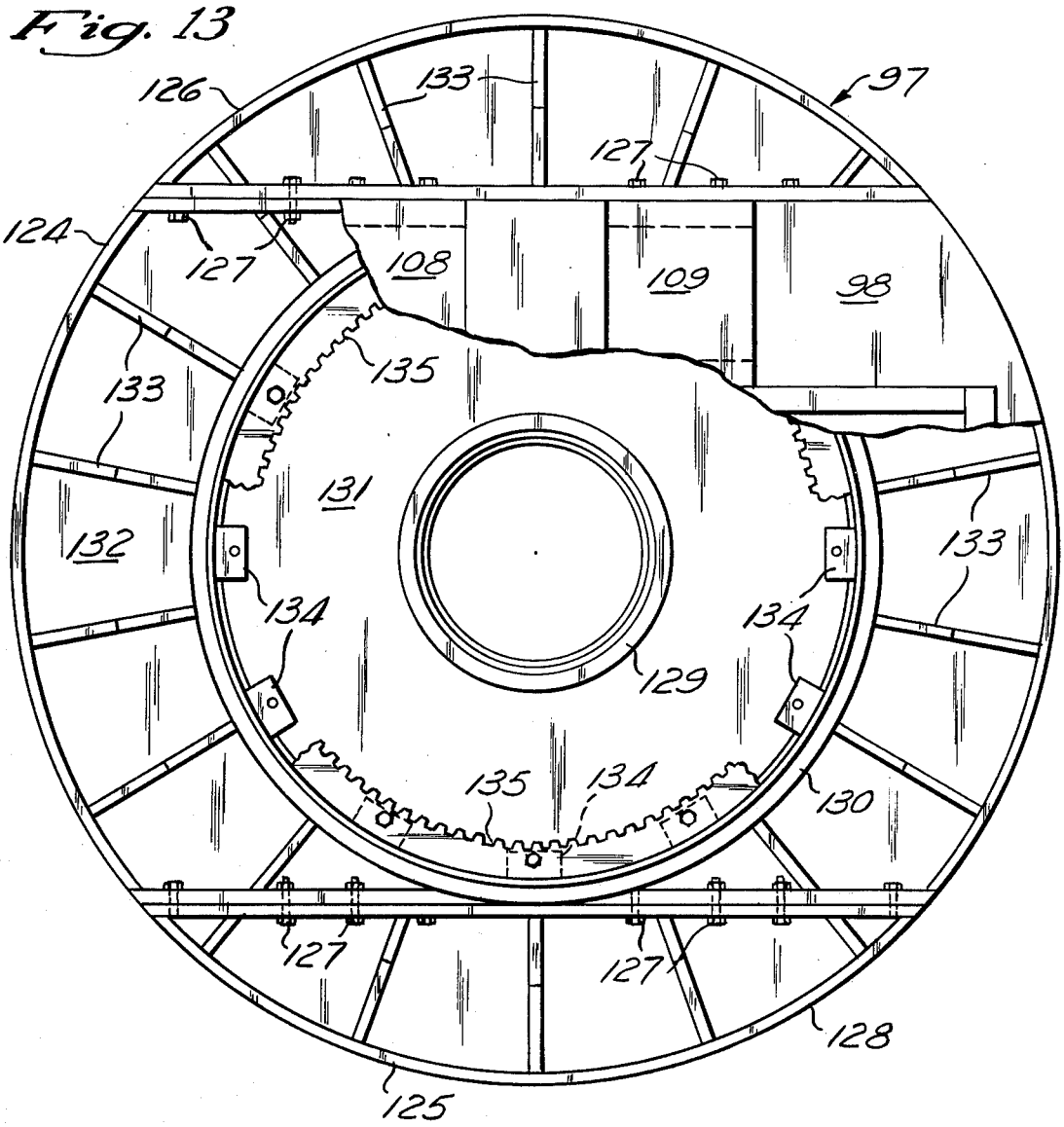
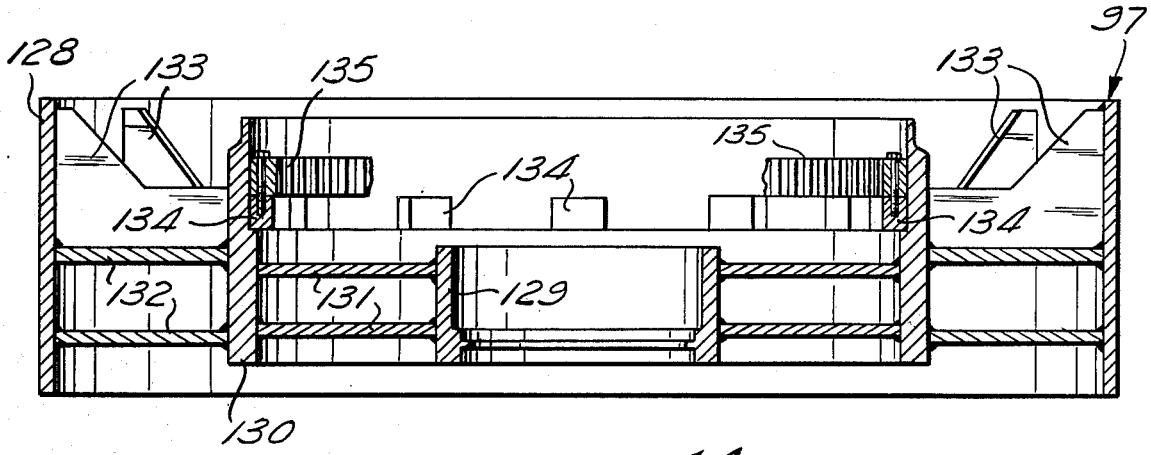
Fig. 14

HARD ROCK TRENCH CUTTING MACHINE

BACKGROUND AND SUMMARY OF THE INVENTION

Trench cutting machines are used in a wide variety of environments and for a wide variety of purposes. One such environment is soft dirt or clay, such as is frequently encountered in digging trenches for water lines or sewers or electrical lines which are buried a relatively short distance below the earth's surface in a soft dirt or clay. In other environments, trenches must be cut in medium hard rock formations (that is, formations having a compressive strength on the order of 6,000 – 12,000 psi, such as limestone and sandstone) and in extremely hard rock formations (that is, formations having a compression strength of 25,000 psi minimum, such as diorite, granite, quartzite, or basalt).

The prior art has provided a variety of machines for cutting trenches. Certain of these prior art devices are shown in U.S. Pat. Nos. 3,219,390, 3,374,034, 3,472,555 and 3,148,917.

The present invention departs from these and other prior art trench cutting machines by providing a hard rock trench cutting machine which is particularly well suited for use in underground mining when medium hard to extremely hard earth formations are encountered. In such mining, a vein of coal or ore which is mined may be of insufficient height to permit a mining railroad car to travel through the space which is left after the vein is mined. The hard rock trench cutting machine according to the present invention is used to cut a trench through the hard rock at the bottom of the vein to provide a trench of sufficient depth to permit a mining railroad car to travel in the trench to permit removal of coal or ore from more remote locations in the vein.

The present invention accomplishes this by providing a hard rock trench cutting machine which includes a main body assembly, a cutter wheel assembly, and a longitudinal thrust assembly.

The main body assembly includes two longitudinally extending support booms, each having a forward portion and a rearward portion. Two pairs of laterally opposed side wall support feet on the rearward portion of the booms move laterally outwardly relative to the booms and push against the trench side walls with a force sufficient to secure the booms against longitudinally movement relative to the side walls. The forward portions of the booms are connected to one another by a removable yoke.

The cutter wheel assembly includes a cutter wheel frame slidably carried by the forward portions of the support booms. The cutter wheel frame includes a cutter wheel drum rotatably carried by the cutter wheel frame for rotation about a predetermined axis. The cutter wheel drum carries a plurality of roller cutters for engaging the end face of the trench. A rotational drive means rotates the cutter wheel drum relative to the cutter wheel support frame.

The longitudinal thrust assembly includes two double acting hydraulic cylinders. Each of the cylinders has one end connected to the main body assembly and another end connected to the cutter wheel frame of the cutter wheel assembly. During cutting of the trench, the cutter wheel drum is rotated and the double acting cylinders extend to push the cutter wheel frame longitudinally along the booms. When the cutter wheel frame reaches the forward end of the booms, the cutter wheel drum is stopped and the support feet on the main body assembly are retracted. The hydraulic cylinders are then retracted to pull the main body assembly forwardly to the cutter wheel assembly. The support feet of the main body assembly are then extended to start another cycle of the machine.

BRIEF DESCRIPTION OF THE DRAWINGS

These and other features and advantages of the present invention are shown in the preferred embodiment of the invention illustrated in the drawings, wherein:

FIG. 10 is a perspective view of the cutter wheel support frame subassembly for the machine shown in FIG. 1;

FIG. 11 is a view taken along reference view line 11—11 in FIG. 10.

FIG. 12 is a schematic cross sectional side elevational view of the cutter wheel support frame subassembly shown in FIG. 10 with the support boom subassembly of FIG. 8 shown in phantom to illustrate the angular relation therebetween;

FIG. 13 is a top plan view of the cutter wheel drum for the machine shown in FIG. 1, with a portion of the cutter wheel support frame shown;

FIG. 14 is a cross sectional side elevational view of the cutter wheel drum shown in FIG. 13;

DETAILED DESCRIPTION OF THE DRAWINGS

Figure 1:
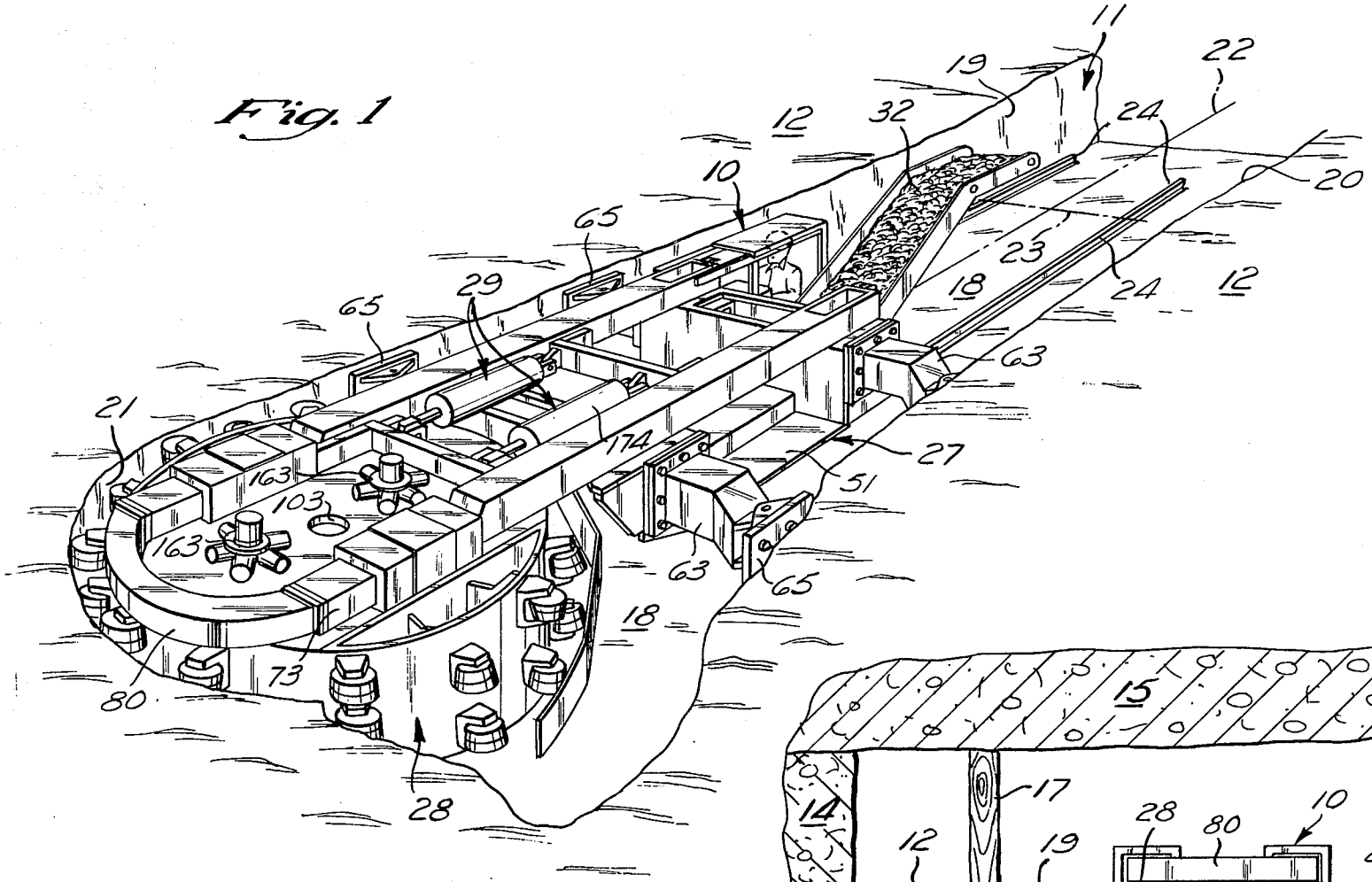
FIG. 1 is a perspective view of a hard rock trench cutting machine according to applicant's invention in a coal mine for cutting a trench in the mine, with portions of the wall of the trench broken away to more fully show the machine.
Figure 2:
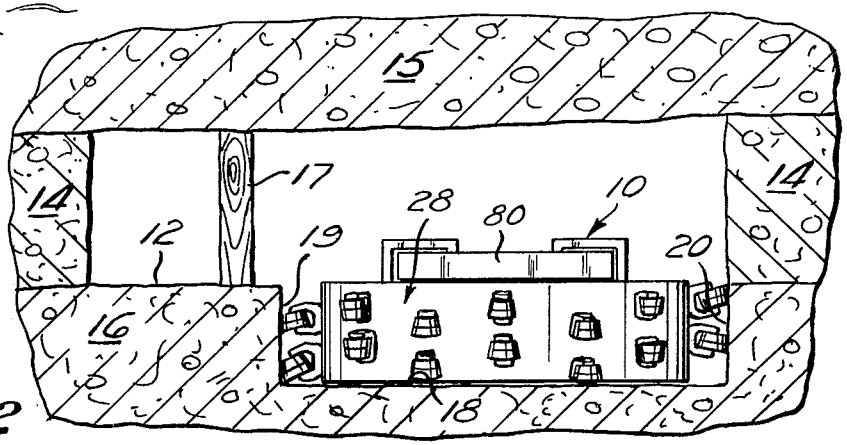
FIG. 2 is a front elevational view of the machine shown in FIG. 1 in the mine, with the end face of the mine removed to show the relation of the cutting machine to the mine.

Referring now to the drawings in greater detail, FIGS. 1 and 2 show a hard rock trench cutting machine 10 cutting a trench 11 in a floor 12 of a mine. The mine floor 12 is formed by removing coal from a vein 14 which is disposed between upper and lower hard rock strata 15 and 16. Suitable mine roof supports 17 are provided along the length of the mine.

The horizontal coal vein 14 is not of sufficient height to permit a mine railroad car to pass between the upper and lower hard rock strata 15 and 16. The hard rock trench cutting machine 10 is used to cut the trench 11 in the lower hard rock stratum 16 to provide sufficient vertical height to permit passage of a mine railroad car. The trench 11 which is cut includes a substantially horizontal bottom wall 18, two substantially vertical opposed side walls 19 and 20, a substantially vertical semicircular end wall 21, and an open top. The trench 11 has a horizontal axis 22 extending parallel to the side walls 19 and 20 and parallel to the bottom wall 18. The trench 11 also has a lateral axis 23 extending between the side walls 19 and 20 parallel to the bottom wall 18 and perpendicular to the horizontal axis 22. Railroad tracks 24 are laid on the trench bottom wall 18 as the trench is cut.

Referring still to FIGS. 1 and 2, the trench cutting machine 10 includes a main body assembly 27, a cutter wheel assembly 28, and a longitudinal thrust assembly 29. As explained in greater detail below, the cutter wheel assembly 28 is slidably disposed on the body assembly 27, and the longitudinal thrust assembly 29 acts between the body assembly 27 and the cutter wheel assembly 28 to effect relative longitudinal movement therebetween for advancing the body assembly 27 and the cutter wheel assembly 28 in the mine. In the disclosed preferred embodiment of an invention the trench cutting machine 10 weighs in excess of 50 tons, and the machine cuts a trench 13 feet wide and is capable of exerting a longitudinal force against the tunnel end face 21 in excess of 175,000 pounds.

Figure 4:
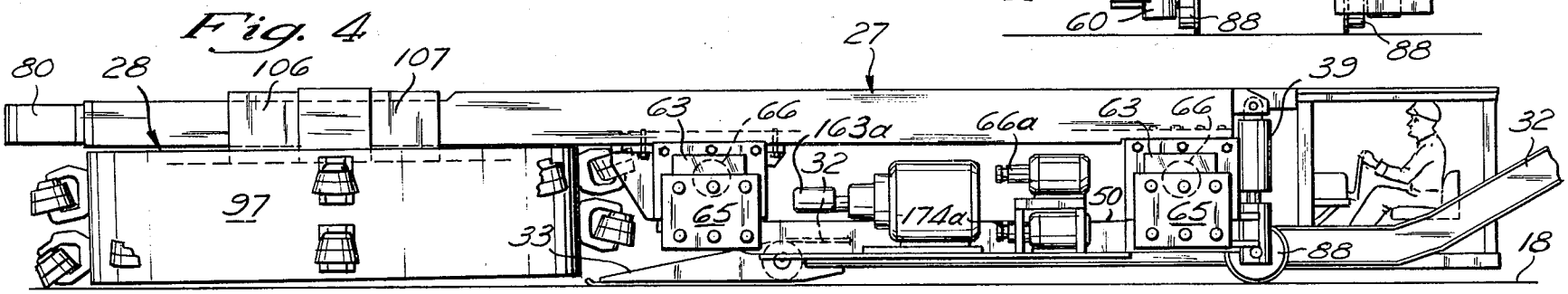
FIG. 4 is a side elevational view of the machine shown in FIG. 1, with a portion of the conveyor omitted.

The trench cutting machine 10 also includes a material conveyor system having an endless conveyor belt 32 (FIGS. 1 and 4) and an inclined ramp 33 (FIG. 4). The material which is cut from the end wall 21 of the trench is pushed up the inclined ramp 33 to the moving conveyor belt 32. The conveyor belt 32 carries the material back to the rear of the machine, where it may fall into a mine railroad car on the tracks 24. The inclined ramp 33 may also be provided with movable scoops or arms (not shown) which push the material up the inclined ramp 33 to the conveyor belt 32. A suitable material guide or fence 34 directs the material to the ramp 33 and conveyor belt 32 and suitable spring loaded scrapers (not shown) may advantageously be utilized on the cutter wheel to move the material toward the ramp 33 as the cutter wheel rotates.

Figure 3:
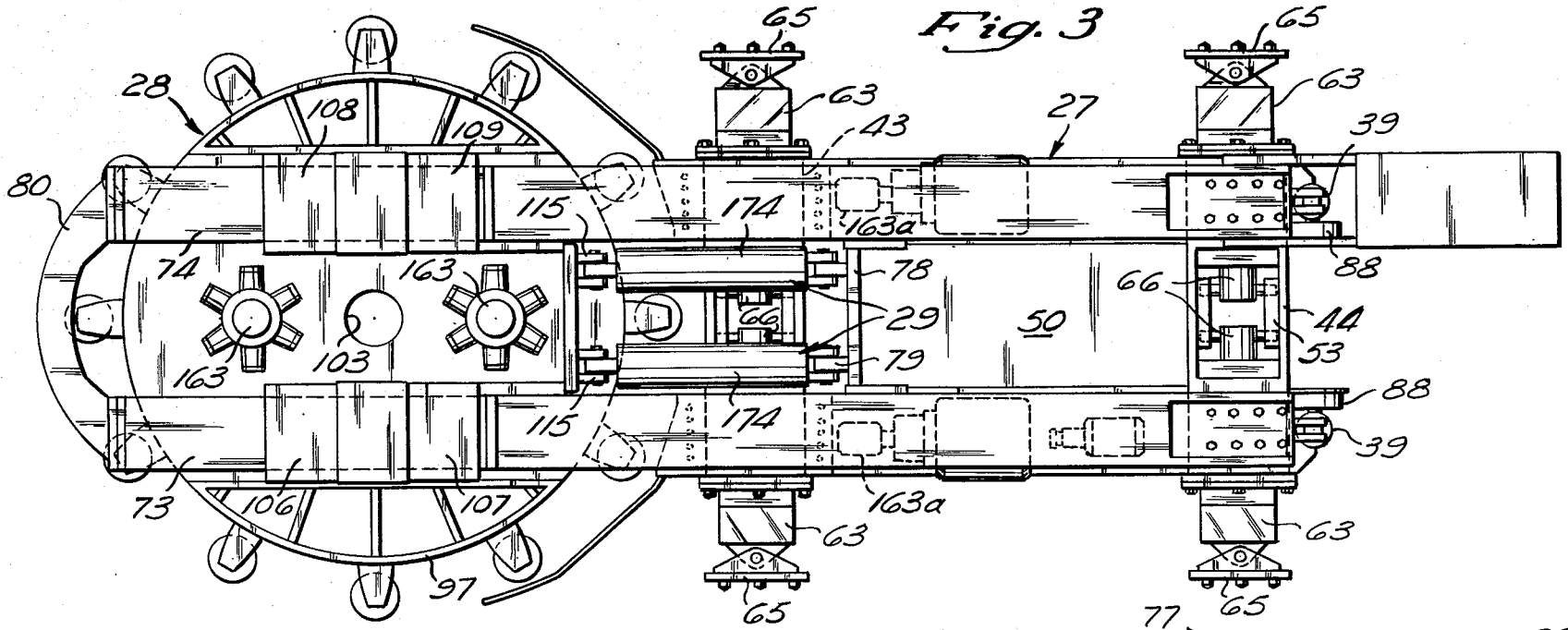
FIG. 3 is a top plan view of the machine shown in FIG. 1, with the conveyor omitted for clarity.
Figure 5:
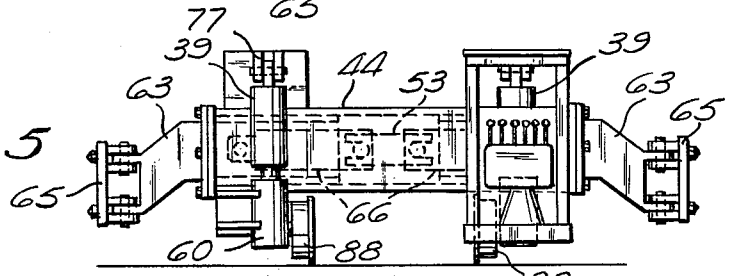
FIG. 5 is a rear view of the machine shown in FIG. 1.

FIGS. 3, 4 and 5 show the body assembly 27 and cutter wheel assembly 28 and thrust assembly 29 assembled together. In other figures of the drawings, these three main components of the machine 10 are shown separately for clarity. Once these three main components are understood by reference to such other figures of the drawings, FIGS. 3, 4 and 5 may be referred to to show the detailed assembly of these three main components.

A. Body Assembly

Figure 7:
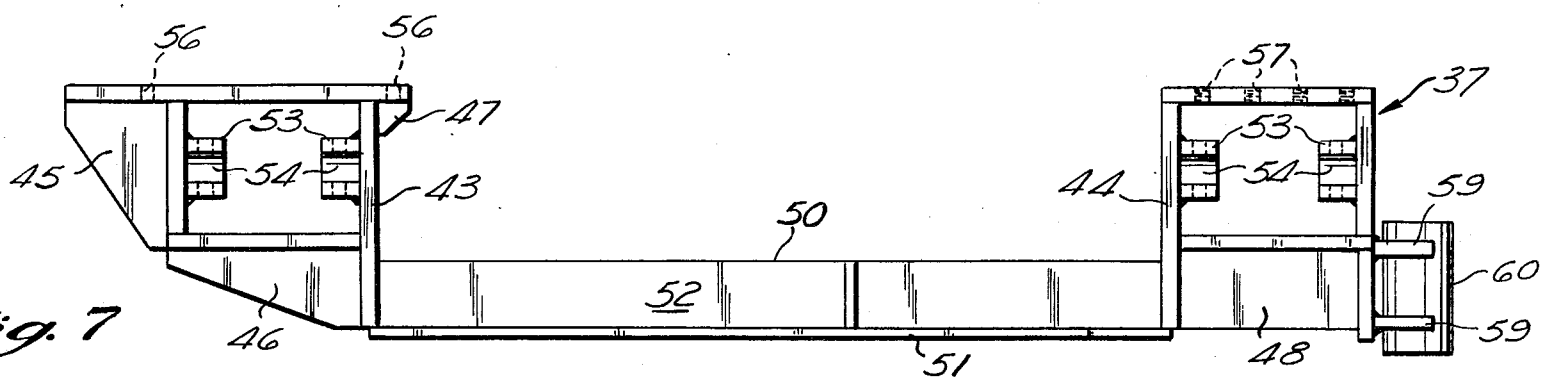
FIG. 7 is a side elevational view of the main body frame subassembly shown in FIG. 6.
Figure 8:
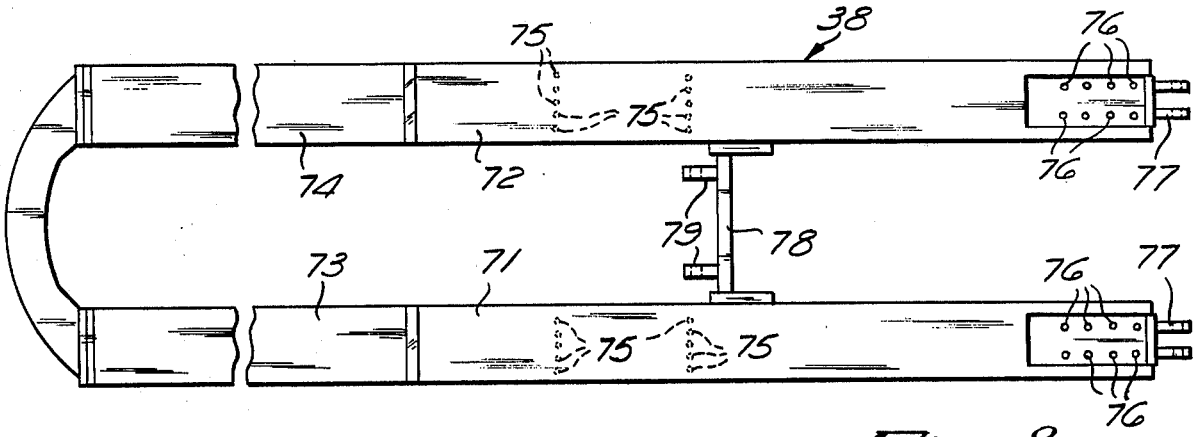
FIG. 8 is a top plan view of the support boom subassembly for the machine shown in FIG. 1.
Figure 9:
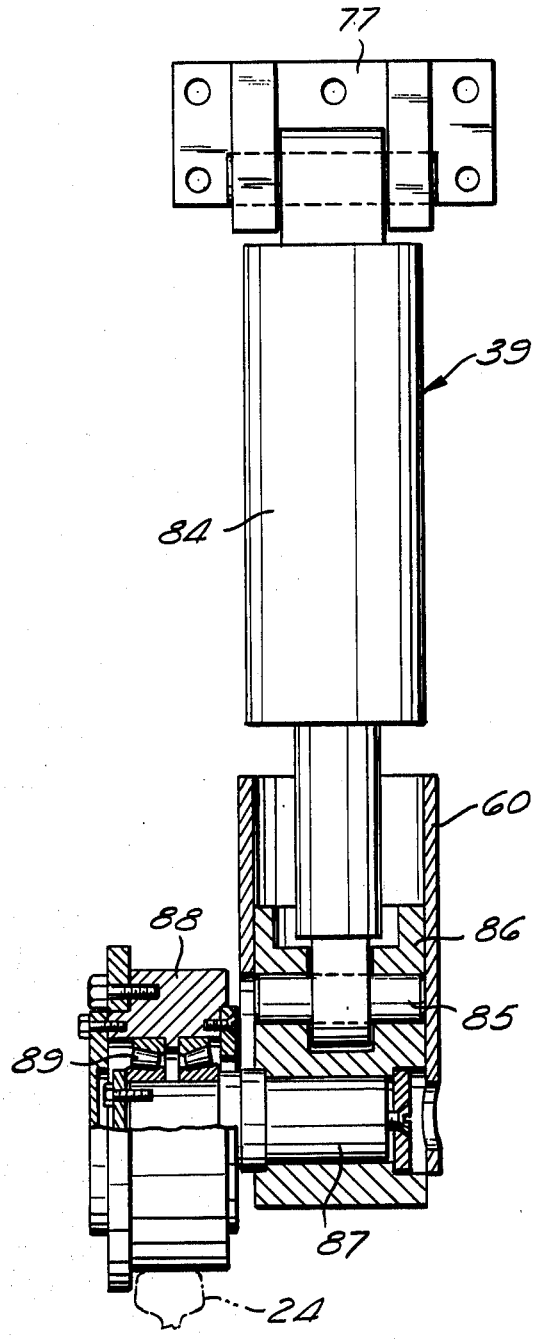
FIG. 9 is a rear view of one of the rear wheel lift subassemblies for the machine shown in FIG. 1.

Referring now to FIGS. 6 – 9, the body assembly 27 includes a body frame subassembly 37 (FIGS. 6 and 7), a body support boom subassembly 38 (FIG. 8), and two rear lift subassemblies 39 (one of which is shown in FIG. 9).

Figure 6:
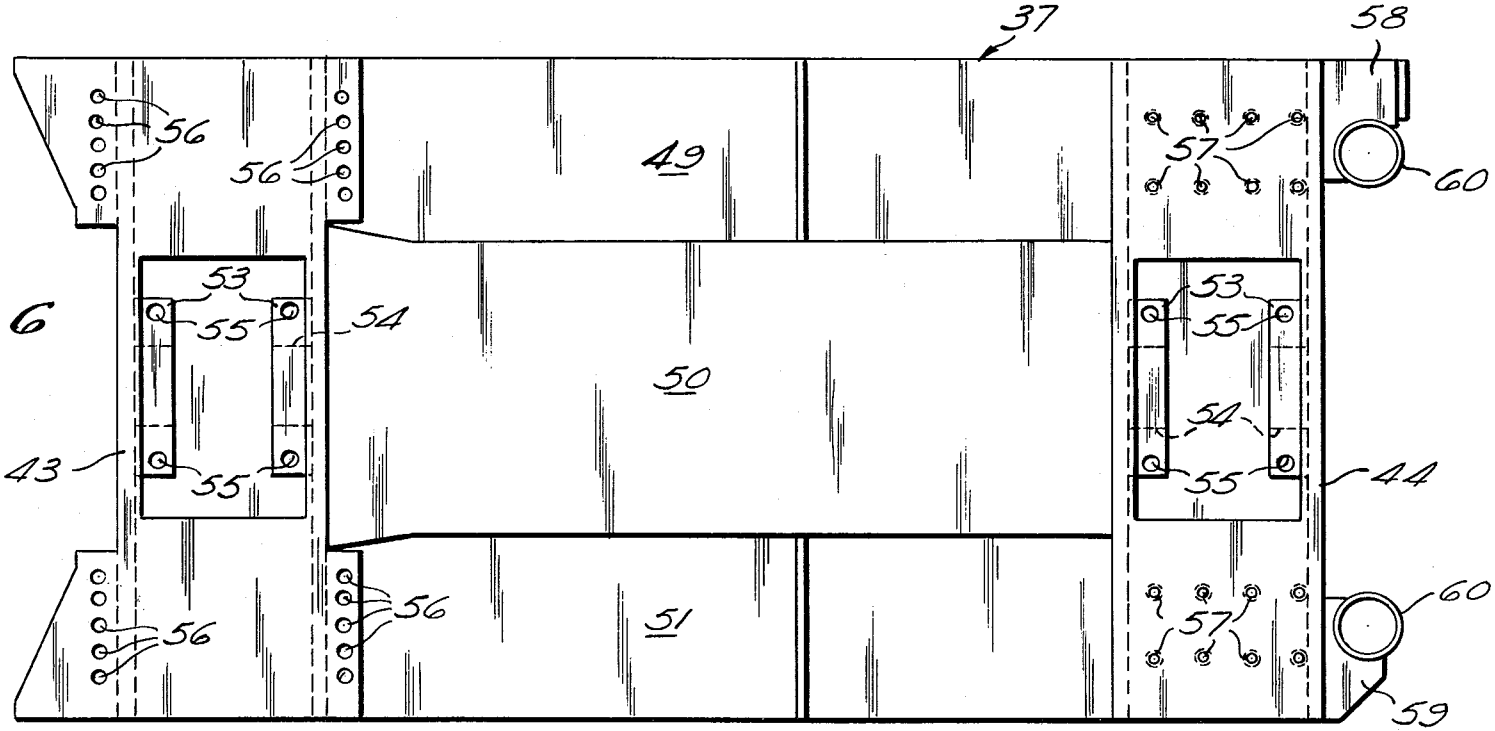
FIG. 6 is a top plan view of a main body frame subassembly for the machine shown in FIG. 1.

Referring now to FIGS. 6 and 7, the body frame 37 includes a generally hollow rectangular forward box 43 and a generally hollow rectangular rearward box 44. The boxes 43 and 44 are open-ended and are made of suitable steel plate which is welded together. Suitable forward gusset plates 45, 46 and 47 and rearward gusset plates 48 are provided to give sufficient rigidity to the forward and rearward boxes 43 and 44. Three generally flat horizontal bottom frame members 49, 50 and 51 extend between the boxes 43 and 44. The member 50 is disposed vertically above the members 49 and 51, and vertical side plates 52 extend vertically between the frame members 49 and 50 and between the frame members 51 and 50.

Referring still to FIGS. 6 and 7, the boxes 43 and 44 are each provided with a pair of hydraulic cylinder mounting brackets 53. The cylinder mounting brackets 53 are each generally rectangular and are slotted laterally inwardly from each end to provide a laterally facing slotted opening 54 at each of their ends. Each of the cylinder mounting brackets 53 also includes suitable holes 55 which extend into the slotted openings 54 for receiving a removable pin (not shown) for removably holding a hydraulic cylinder in place as described further below.

The top plate of the forward box 43 is provided with a plurality of holes 56 for receiving bolts to secure the body support boom subassembly 38 to the body frame 37. The top plate of the rearward box 44 is provided with a plurality of threaded holes 57 for threadably receiving suitable bolts to secure the body support boom subassembly 38 to the body frame 37. A pair of cylindrical vertically extending rear body lift guides 60 are disposed on the rearward portion of the body frame 37. The guides 60 are welded to suitable support plates 58 and 59 for securing the guides 60 in place.

Although omitted from FIGS. 6 and 7 for clarity, the body frame 37 also includes four identical side support feet 63 telescopically received within the boxes 43 and 44 and shown in FIG. 3, 4 and 5. Each side support foot 63 includes a hollow open-ended box of rectangular configuration which is slidably disposed for lateral movement within the forward and rearward boxes 43 and 44. Each side support foot 63 also includes a gripping plate 65 which is pivotably mounted about a vertical axis on the radially outwardly facing end of the portion of the support foot 63 which is telescopically received within its corresponding one of the boxes 43 and 44. Each side support foot 63 also includes a laterally extending double-acting hydraulic cylinder 66. Each of the hydraulic cylinders 66 has a laterally inward end pivotally connected by a longitudinally extending pin in its associated one of the cylinder mounting brackets 53. The other end of each double-acting hydraulic cylinder 66 is suitably secured to the portion of its associated support foot 63 which is telescopically disposed in its associated one of the boxes 43 and 44. By this arrangement of the support feet 63, each support foot is independently actuatable for movement between an extended position engaging the tunnel side walls 19 and 20 (FIG. 1) and a retracted position (FIGS. 3 and 5). Additionally, each support foot 63 includes a bolted joint at its mid portion which permits the laterally outwardly extending portion of the foot to be removed from the portion of the foot which is inside the box 43 or 44. This reduces the width of the main body assembly 27 for passage through narrow shafts or tunnels.

Referring now to FIG. 8, the main body support boom subassembly 38 includes left and right longitudinally extending support booms 71 and 72. Each of the support booms 71 and 72 is an elongated hollow structure of retangular lateral crosssectional configuration which is constructed by welding steel plates together. The support booms 71 and 72 include machined forward end portion 73 and 74, respectively, which are machined on all four outside walls to provide a smooth surface on which the cutter wheel assembly (not shown in FIG. 8) is mounted. A plurality of threaded holes 75 extend from the bottom surface of the booms 71 and 72 to the hollow interior of the booms. When the body support boom subassembly 38 is secured on the body frame 37 (FIG. 6), bolts which extend through the holes 56 in the body frame 37 (FIG. 6) are threadably received in the threaded holes 75 in the support booms 71 and 72. The bottom surface of the support booms 71 and 72 also includes suitable holes 76 which extend from the hollow interior of the support booms completely through the bottom plate. An opening is cut in the top surface of the support booms 71 and 72 immediately above the holes 76 to provide access thereto. When the body support boom subassembly 38 is assembled on the body frame 37 (FIG. 6), bolts (not shown) extend through the holes 76 and are threaded into the threaded openings 57 of the body frame 37 (FIG. 6).

Still referring to FIG. 8, each support boom 71 and 72 is provided with a cylinder support bracket 77. A tie bracket 78 extends between the support booms 71 and 72 and is bolted to each of the support booms by suitable bolts (not shown). Two thrust cylinder mounting brackets 79 are provided on the tie bracket 78. After the cutter wheel assembly 28 is placed on the booms 71 and 72 in a manner further described below, a front yoke 80 (also shown in FIG. 3) is removably bolted to the free ends of the booms 71 and 72.

The structural details of one of the two rear body lift subassemblies 39 are shown in FIG. 9. Each of the two rear lift subassemblies 39 includes a double-acting hydraulic cylinder. The cylinder end of the double-acting hydraulic cylinder 84 is connected to one of the cylinder support brackets 77 of the body support boom subassembly 38 (FIG. 8). The rod end of the double-acting hydraulic cylinder 84 is connected by a pin 85 to a plunger 86 which is slidably disposed within one of the guides 57 of the body frame 37 (FIGS. 6 and 7). A stub axle 87 is secured to the bottom end of the plunger 86, and the stub axle 87 extends laterally outwardly from the plunger 86 through a vertical slot in the guide 60. A wheel 88 is rotatably journaled on the stub axle 87 by a bearing 89. The wheel 88 has a removable annular flange which is used when the machine is moved on existing tracks in the mine and which is removed so that the wheel 88 rolls on the bottom wall 18 during cutting of the trench. As discussed further below, each of the two rear lift subassemblies 39 is individually hydraulically actuatable for moving its associated wheel 88 between an extended position shown in FIG. 9 to support the rear of the trench cutting machine 10 and a retracted position in which the wheel 88 is spaced vertically above the bottom wall 18 of the trench 11 during cutting of the end wall 21 (FIG. 1).

B. Cutter Wheel Assembly

The cutter wheel assembly 28 (FIG. 1) includes a cutter wheel frame 9 shown in FIGS. 10, 11 and 12, and a cutter wheel 97 shown in FIGS. 13 and 14.

Referring now to FIGS. 10, 11 and 12, the cutter wheel frame 96 includes a mounting plate 98. The mounting plate 98 is a generally flat steel plate having two generally flat laterally facing side edges 99 and 100 and two opposed rounded forward and rearward edges 101 and 102. A central main bearing mounting hub 140 extends vertically through the center of the mounting plate 98. Forward and rearward motor mounting holes 104 and 105 located longitudinally forwardly and longitudinally rearwardly of the hole 103 are provided for mounting the motors which drive the cutter wheel 97 in a manner described in greater detail below.

Still referring to FIGS. 10, 11 and 12, the cutter wheel frame 96 also includes a pair of longitudinally aligned left support boom sleeves 106 and 107 and a similar pair of longitudinally aligned right support boom sleeves 108 and 109. In a manner discussed in greater detail, below the support boom forward ends 73 and 74 (FIG. 8) are slidably received within the support boom sleeves 106, 107, 108 and 109.

As best shown in FIG. 11, each of the support boom sleeves 106, 107, 108 and 109 is of rectangular lateral cross-sectional configuration. The support boom sleeves each include top wear pads 110, bottom wear pads 111, and side wear pads 112 and 113. The wear pads are each received in a longitudinally extending slot in the sleeves, and the pads each extend the full longitudinal extent of the sleeve. Suitable drilled passages are provided in the sleeves and pads for lubrication. As shown in FIG. 1, a dust cover is provided between the sleeves 106 and 107 and between the sleeves 108 and 109. Although not shown in the drawings, suitable wipers may also be provided at the forward ends of the sleeves 106 and 108 and at the rearward end of the sleeves 107 and 109 to further minimize the entry of foreign materials into the sleeves. A tie bracket 114 connects thrust cylinder mounting brackets 115.

Referring now to FIG. 12, the disposition of the left support boom sleeves 106 and 107 on the machined forward end 73 of the left support boom 71 is shown. The top and bottom wear pads 110 and 111 are longitudinally tapered to provide a predetermined angular relationship between the support boom forward end 73 and the mounting plate 98 of the cutter wheel frame 96. This predetermined angular relationship may easily be changed by changing the amount of taper of the top and bottom wear pads 110 and 111. This predetermined angular relationship shown in FIG. 12 results in the mounting plate 98 being angularly disposed at an angle 119 of less than five degrees and preferably zero degrees 30 minutes with respect to the boom forward end 73 which extends parallel to the longitudinal axis 22 (FIG. 1). Because the cutter wheel 97 is mounted on the mounting plate 98 so that its axis of rotation, 120 is perpendicular to the mounting plate 98, the axis of rotation 120 of the cutter wheel 97 is perpendicular to the lateral axis 23 (FIG. 1) and is tilted forwardly by an angle 121 which is less than five degrees and preferably zero degrees 30 minutes from a line extending vertically upwardly perpendicular to the longitudinal axis 22. This zero degree 30 minute forward tilt of the axis of rotation 120 of the cutter wheel 97 lifts the rearward most portion of the cutter wheel 97 approximately one and one half inches above the forward most portion of the cutter wheel 97. In this manner, the cutter wheel 97 slides along the boom forward ends 73 and 74 solely in a direction parallel to the longitudinal axis 22 of the trench, yet the rearward most portion of the cutter wheel 97 is lifted upwardly away from the bottom wall 18 of the trench as the cutter wheel 97 turns to minimize clogging beneath the cutter wheel 97 by particles which are cut from the end face of the tunnel.

Referring now to FIGS. 13 and 14, the structural details of the cutter wheel 97 are shown. In FIG. 13, a small segment of the mounting plate 98 to which the cutter wheel 97 is mounted is also shown.

The cutter wheel 97 is of circular longitudinal cross section and is separated into a center segment 124 and side segments 125 and 126 by parallel longitudinally extending chords. The side segments 125 and 126 are removably secured to the center segment 124 by suitable bolts 127. This enables disassembly of the side segments 125 and 126 to permit passage through a narrow shaft or tunnel when the side segments 125 and 126 and the four outer portions of the side support feet 63 are removed, as may be understood by reference to FIG. 3.

When the side segments 125 and 126 are bolted to the center segment 124, an outer cylinder 128, an inner cylinder 129, and an intermediate cylinder 130 are formed as shown in FIG. 14. The inner cylinder 129 is connected to the intermediate cylinder 130 by annular disc-like connecting plates 131. In a similar manner, the outer cylinder 128 is connected to the intermediate cylinder 130 by connecting plates 132, which are annular when the cutter wheel 97 is bolted together as shown in FIGS. 13 and 14. Vertical reinforcing plates 133 are also provided between the outer cylinder 128 and the intermediate cylinder 130 for additional strength.

Still referring to FIGS. 13 and 14, a plurality of mounting pads 134 are welded to the inner peripheral surface of the intermediate cylinder 130. An annular ring gear 135 is bolted to the support pads 134.

Figure 15:
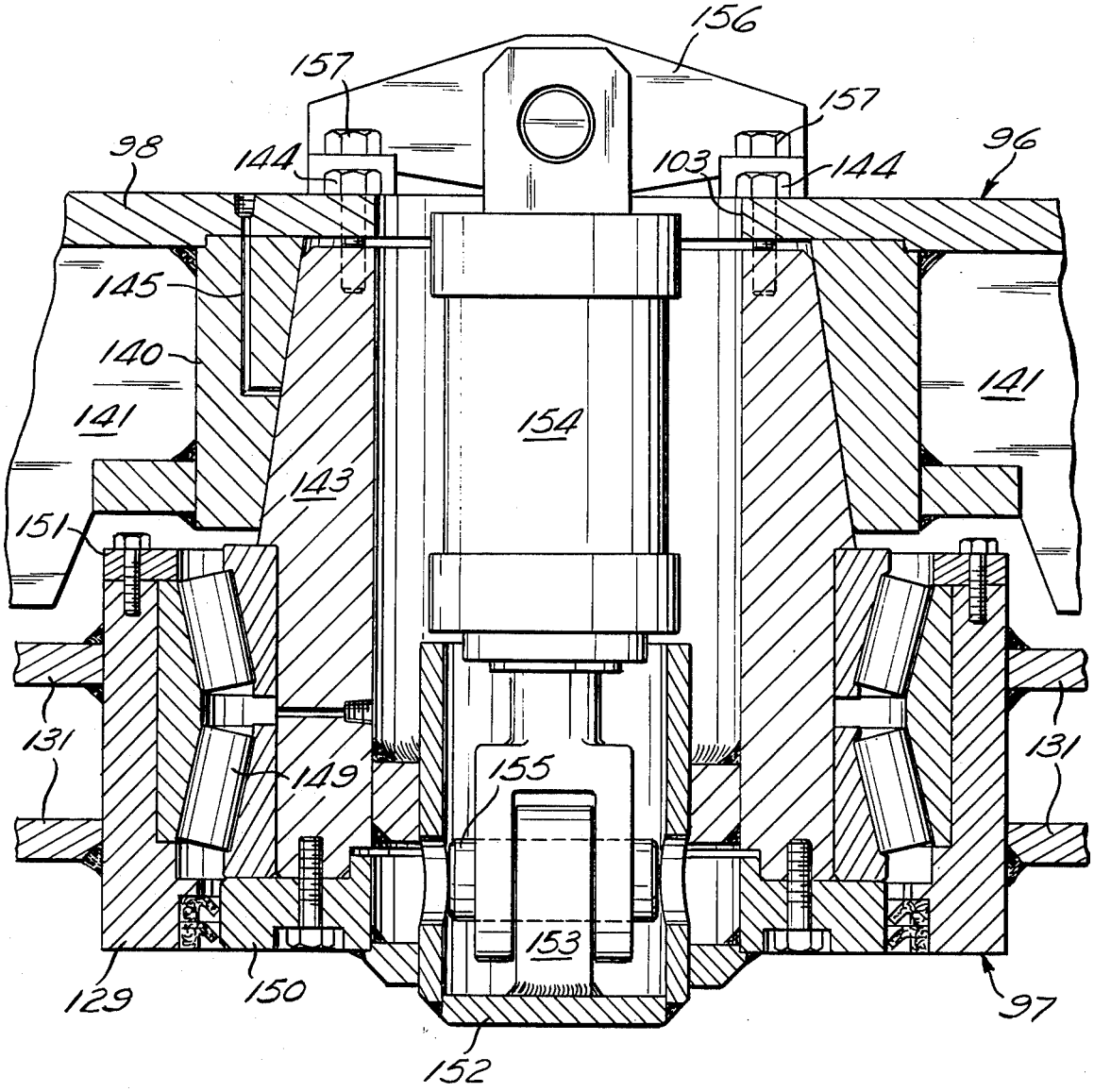
FIG. 15 is a partial side elevational cross sectional view of the cutter wheel drum shown in FIG. 13 mounted on the cutter wheel support frame shown in FIG. 10, and with a cutter wheel support foot attached thereto.

Referring now to FIG. 15, the mounting of the cutter wheel 97 on the cutter wheel frame 96 is shown. The cutter wheel frame 96 includes an annular mounting ring 140 welded to the mounting plate 98. Suitable reinforcing plates 141 are welded to the mounting plate 98 and mounting ring 140 for additional strength. A removable annular bearing support shaft 143 is received in a conical opening in the mounting ring 140 and is provided with a matching conical outer peripheral surface. The bearing support shaft 143 is removably secured to the mounting plate 98 by bolts 144, and a suitable fluid passage 145 is provided to supply high pressure fluid to the engaging conical surfaces of the mounting ring 140 and bearing support shaft 143 to release the bearing support shaft 143 when the bolts 144 are removed.

A suitable bearing 149 is provided to permit rotation of the cutter wheel 97 with respect to the cutter wheel frame 96. An end cap 150 secures the inner race of the bearing 149 to the bearing support shaft 143, and an end cap 151 secures the outer race of the roller bearing 149 to the cutter wheel 97. In this manner, the cutter wheel 97 is carried on the cutter wheel frame 96 for rotational movement of the cutter wheel 97 relative to the cutter wheel frame 96.

Still referring to FIG. 15, a cup-shaped front lift foot 152 is provided with an ear portion 153 which is connected to a front lift cylinder 154 by a clevis 155. The lift cylinder 154 is pivotally connected to the mounting plate 98 by a mounting bracket 156 and bolts 157. The bolts 157 are circumferentially spaced from the bolts 144 around the periphery of the support foot mounting hole 103. The cylinder 154 is a double-acting hydraulic cylinder which is operable to extend the front lift foot 152 downwardly as viewed in FIG. 15 to raise and lower the cutter wheel 97 relative to the bottom wall 18 of the trench. During cutting of the trench, the lift foot 152 is positioned against the trench bottom wall 18 to carry the weight of the cutter wheel and eliminate any rotational forces on the support feet 63 caused by the over hung weight of the cutter wheel.

Figure 16:
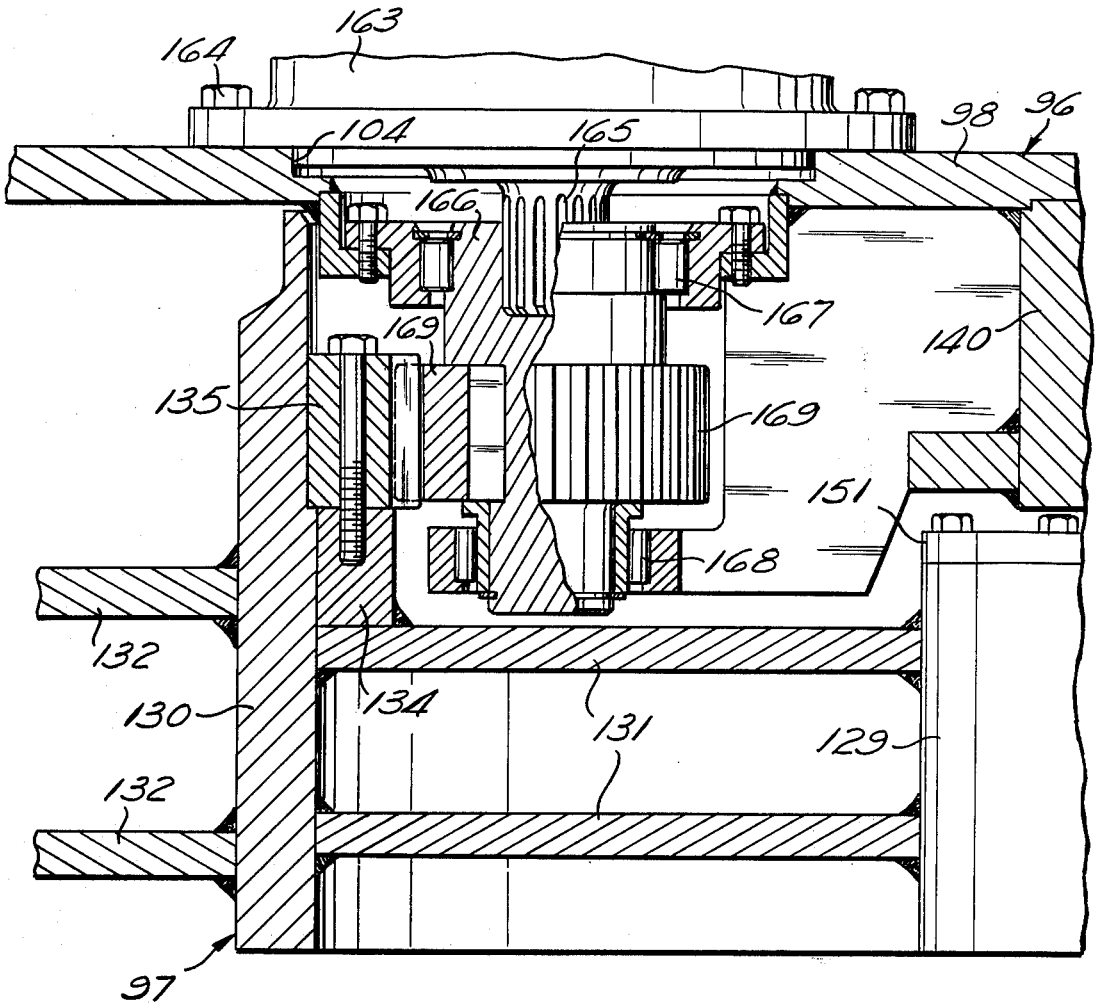
FIG. 16 is a partial side elevational cross sectional view showing one of the two drive motors mounted on the cutter wheel support frame for rotating the cutter wheel drum.

Referring now to FIG. 16, the mounting of one of the hydraulic motors for rotating the cutter wheel 97 is shown. As will be seen by reference to FIGS. 3 and 10, there are two identical hydraulic motors mounted on the support plate 98, and the hydraulic motor which is mounted in the motor mounting hole 104 is illustrated in FIG. 16.

Referring still to FIG. 16, a hydraulic motor 163 is secured to the mounting plate 98 by bolts 164. The hydraulic motor 163 includes a splined motor shaft 165 which fits into a suitable opening in a stub shaft 166. The stub shaft 166 is rotatably journaled on the mounting plate 98 by an upper bearing 167 and a lower bearing 168. The stub shaft 166 carries a pinion 169 which is keyed to the stub shaft 166 for driving the ring gear 135 to rotate the cutter wheel 97 when the motor shaft 165 is rotated.

C. Thrust Assembly

The construction of the longitudinal thrust assembly 29 (FIG. 1) which acts between the main body assembly 27 and the cutter wheel assembly 28 is best shown in FIGS. 3, 8 and 10. As shown in FIG. 3, the longitudinal thrust assembly 29 includes two double-acting hydraulic cylinders 174. The cylinder end of each of the cylinders 174 is connected by suitable pins to one of the thrust cylinder mounting brackets 79 (FIG.8) of the body support boom subassembly 38 of the body assembly 27. The rod end of each hydraulic cylinder 174 is connected by a suitable pin to one of the thrust cylinder mounting brackets 115 (FIG. 10) of the cutter wheel frame 96 of the cutter wheel assembly 28.

D. Hydraulic Circuit

Figure 17:
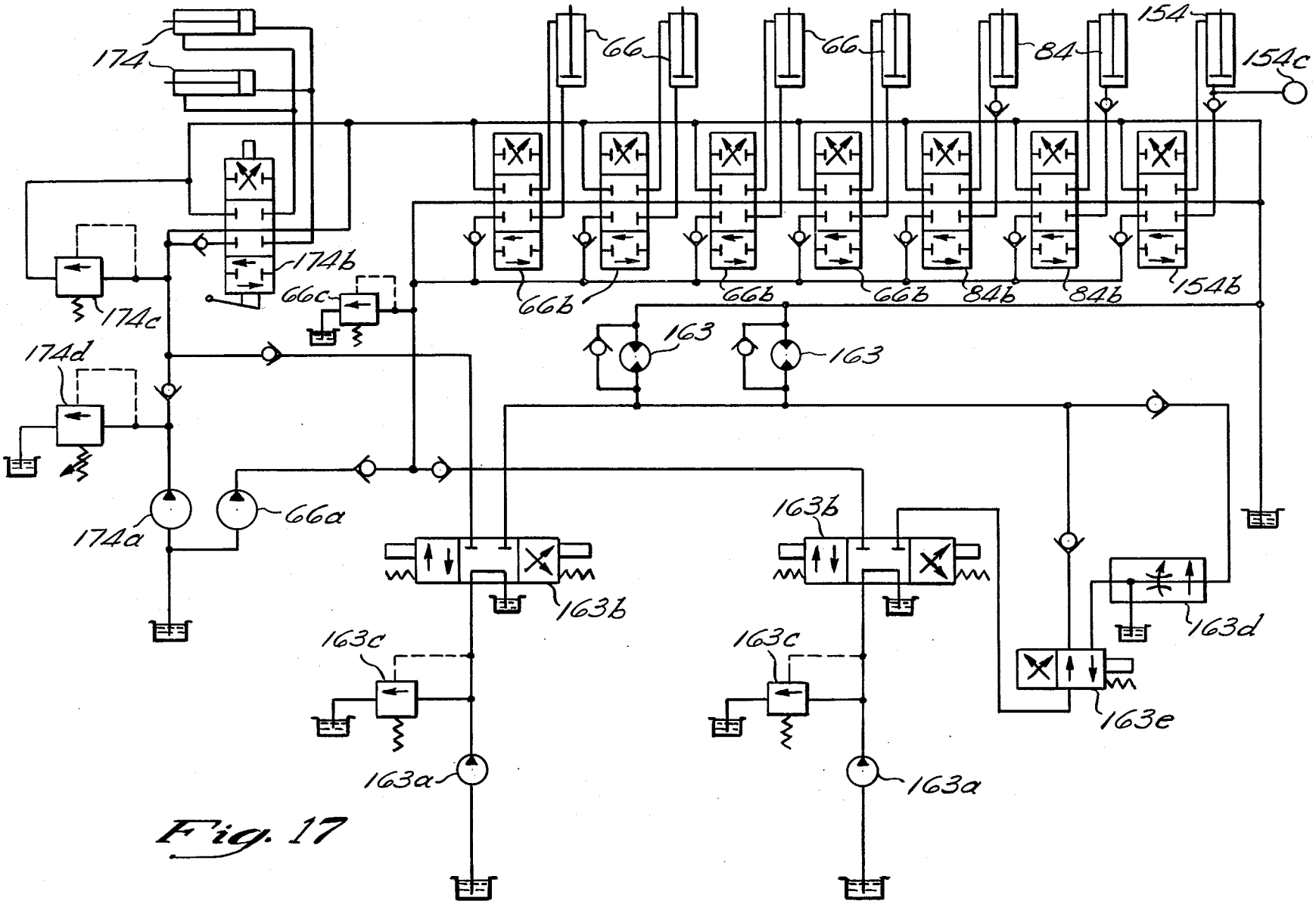
FIG. 17 is a schematic hydraulic circuit diagram of the hydraulic circuit used for the machine shown in FIG. 1.

Referring now to FIG. 17, the hydraulic circuit diagram for the trench cutting machine 10 is shown. The fluid pumps 66*a*, 163*a* and 174*a*, the single front lift cylinder 154, the two rear lift cylinders 84, the four lateral side support cylinders 66, the two longitudinal thrust cylinders 174, and the two cutter wheel hydraulic motors 163, are shown schematically.

To provide fluid pressure for operating the thrust cylinders 174, an electrical motor driven hydraulic thrust pump 174*a* and a manually actuated directional control valve 174*b* are provided. The hydraulic line connecting the pump 174*a* to the thrust cylinders 174 also includes a first pressure relief valve 174*c* and a second pressure relief valve 174*d*. The first relief valve 174*c* limits the pressure supplied to the thrust cylinders 174 to 1750 p.s.i. under all operating conditions. The second relief valve 174*d* is adjustable up to 1750 p.s.i. to adjustably limit the force exerted by the thrust cylinders 174 against the end face of the tunnel. When the directional control valve 174*b* is in its center position shown in FIG. 17, fluid from the pump 174*a* flows to the fluid reservoir for the system. When the directional control valve 174*b* is moved upwardly, the fluid from the pump 174*a* is directed to extend the cylinders 174 to push the cutter wheel assembly 28 forwardly relative to the body assembly 27. When the valve 174 is moved downwardly, the fluid from the pump 174*a* is directed to the opposite side of the thrust cylinders 174 to retract the cylinders 174.

Still referring to FIG. 17, an electric motor driven hydraulic pump 66*a* supplies fluid pressure to the side support cylinders 66 through manually operated directional control valves 66*b*. A fluid pressure relief valve 66*c* limits the pressure supplied by the pump 66*a* to the side support cylinders to 2500 p.s.i. Because each of the four support cylinders 66 is provided with its own directional control valve 66*b*, the lateral position and alignment of the trench cutting machine 10 is fully adjustable by the four cylinders 66. To extend the cylinders 66, the control valves 66*b* are moved upwardly as viewed in FIG. 17. This connects the pump 66*a* to the piston side of each cylinder 66 and connects the rod side of each cylinder 66 to the drain. Similarly, downward movement of any or all of the control valves 66*b* provide fluid pressure from the pump 66*a* to the rod side of the cylinders 66 to retract the cylinders 66.

The pump 66*a* also provides fluid pressure to the rearward lift cylinders 84 and to the forward lift cylinder 154 through the directional control valves 84*b* and 154*b*, respectively. The lift cylinders 84 and 154 are stationary when the side support cylinders 66 are being extended or retracted, and the side support cylinders 66 are stationary when the lift cylinders 84 and 154 are being extended or retracted. When the cylinders 84 and 154 are to be extended, the directional control valves 84*b* and 154*b* are individually moved upwardly as viewed in FIG. 17. This supplies fluid pressure from the pump 66*a* to the piston side of the cylinders 84 and 154 and connects the rod side of the cylinders to drain. When the cylinders 84 and 154 are to be retracted, the directional control valves 84*b* and 154*b* are moved downwardly. In this manner, and because the rear lift cylinders 84 and front lift cylinder 154 provide a three point support for the trench cutting machine 10, the disposition of the trench cutting machine 10 about its lateral axis may be changed or adjusted. The cylinder 154 is also provided with an accumulator 154*c*. The accumulator 154*c* provides a constant source of fluid pressure to the piston side of the front left cylinder 154 when the directional control valve 154*b* is in its center position and the tunnel end face is being cut.

The two hydraulic motors 163 for driving the cutter wheel 97 are positive displacement radial piston motors which provide high torque at low speed. A reverse flow check valve is provided in parallel with each of the motors 163 to prevent the motors 163 from drawing a vacuum when the source of fluid pressure to the motors 163 has been shut off and the cutter wheel 97 is coasting. Two gear pumps 163*a* driven by electric motors provide a source of fluid pressure for the two cutter wheel motors 163. Two directional control valves 163*b* control communication between the pumps 163*a* and the motors 163, and relief valves 163*c* limit the maximum working pressure which may be provided to the motors 163. When the motors 163 are to be operated to rotate the cutter wheel 97, the control valves 163*b* are each displaced to the left as viewed in FIG. 17. This connects the two pumps 163*a* to the motors 163. When rotation of the cutter wheel 97 is to be stopped, the control valves 163*b* are returned to their center position shown in FIG. 17.

The speed of rotation of the cutter wheel 97 may be controlled by controlling the fluid flow rate to the motors 163. Maximum flow to the motors 163 is achieved when the control valves 163*b* are both displaced to the left as described above. A slow speed for rotation of the cutter wheel 97 is achieved by directing the flow from one of the pumps 163*a* through a flow regulator valve 163*d*. This is accomplished by placing the leftward one of the control valves 163*b* in its neutral position, placing the rightward one of the directional control valves 163*b* in its leftward position, and placing the flow regulating control valve 163*e* in its rightward position to direct the fluid from the rightward one of the control valves 163*b* through the flow regulator 163*d* to the motors 163.

As explained in greater detail below, during one portion of the operation of the machine 10 the thrust cylinders 174 are moved from their extended positions to their retracted positions to move the body assembly 27 forwardly in the trench while the cutter wheel assembly 28 remains stationary. Because the thrust pump 174*a* is a high pressure, low flow rate pump for normal operation during extension of the cylinders 174, a considerable time would be required to retract the cylinders 174 during this portion of the operation of the trench cutting machine 10. To minimize the time required to retract the thrust cylinders 174 (which have a large cross-sectional area to enable them to exert a great force), the left cutter wheel pump 163*a* is added to the output of the thrust pump 174*a* so that the output of the left pair of cutter wheel pumps 163*a* is added to the output of the thrust pump 174*a* to permit fast retraction of the thrust cylinders 174. This is accomplished by moving the leftward one of the control valves 163*b* to its rightward position while the control valve 174*b* is in its downward position.

During another portion of the operation of the machine 10, the side support cylinders 66 are moved from their extended positions to their retracted positions, or from their retracted positions to their extended positions. Because the combined cross-sectional area of the four cylinders 66 is quite large, the cylinders 66 would retract or extend very slowly if only the output of the pump 66*a* were available. During this portion of the operation of the trench cutting machine 10, the output of the rightward cutter wheel pump 163*a* is added to the output of the side support pump 66*a* to provide a high retraction or extension speed of the side support cylinders 66. This is accomplished by moving the rightward one of the control valves **163*b* to the right as viewed in FIG. 17. The side support control valves 66*b* are then moved upward or downward to extend or retract the side support cylinders 66.**

E. Operation

Referring now to FIG. 18 through 21, the advancing movement of the hard rock trench cutting machine 10 in the trench 11 is shown schematically.

Figure 18:
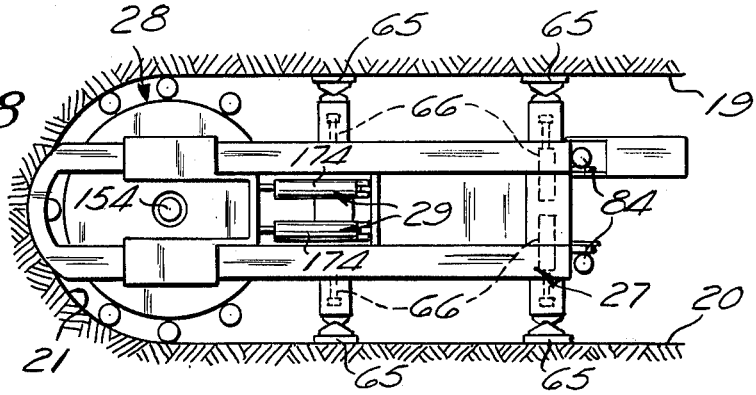
FIG. 18 is a schematic top plan view of the machine shown in FIG. 1, with the machine in a first position at the beginning of a cutting cycle in which the cutter wheel assembly is retracted and the side support feet are extended and with the rear lift wheels retracted.

In FIG. 18, the trench cutting machine is a first position. In this first position, the side support cylinders 66 are hydraulically actuated to push against the tunnel side walls 19 and 20 to secure the body assembly 27 in a predetermined position in the trench. Fluid pressure to the cylinders 66 is supplied from the pump **66*a* (FIG. 17) through the valves 66*b* when the valves 66*b* are all moved from their center position to their upward position. In this first position, the rear lift cylinders 84 are retracted, and the rear lift valves 84*b* (FIG. 17) are in their center position. The front lift cylinder 154 is extended so that the front lift leg 152 (FIG. 15) engages the bottom wall of the trench to overcome any tendency of the cutter wheel 28 to dive vertically downwardly. The front lift leg control valve 154*b* (FIG. 17) is in its center position, and the front lift leg accumulator 154*c* maintains the necessary pressure on the piston side of the front lift cylinder 154.**

When the trench cutting machine is in its first position shown in FIG. 18, the cutter wheel valves **163*b* (FIG. 17) are moved from their center positions to their leftward positions to supply fluid pressure from the two pumps 163*a* to the cutter wheel motors 163. When the cutter wheel is rotating, the thrust assembly 29 is actuated to advance the cutter wheel assembly 28 longitudinally relative to the body assembly 27. This is accomplished by moving the thrust valve 174*b* (FIG. 17) from its center position to its upward position to supply fluid pressure from the thrust pump 174*a* to the piston side of the thrust cylinders 174. The adjustable relief valve 174*b* is set to limit the pressure supplied to the thrust cylinders 174 in accordance with the particular earth formations which are being cut by the trench cutting machine. The cutter wheel assembly 28 then advances to the left as viewed in FIG. 18, slidding along the support booms of the body assembly 27.**

Figure 19:
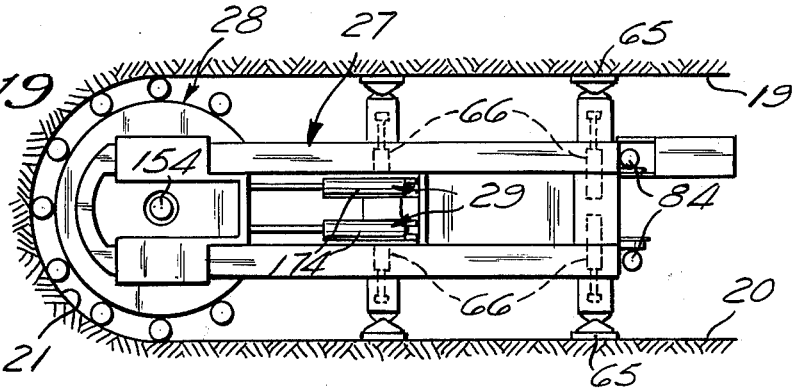
FIG. 19 is a schematic top plan view of the machine shown in FIG. 1, with the machine in a second position during a cutting cycle with the cutter wheel assembly extended and with the side support feet extended and with the rear lift wheels retracted.

When the thrust cylinders 174 are fully extended and the cutter wheel assembly 28 is at the free end of the support booms of the body assembly 27, the trench cutting machine reaches its second position shown in FIG. 19. When this second position shown in FIG. 19 is reached, the fluid supplied to the cutter wheel motors 163 (FIG. 17) is terminated by returning the cutter wheel control valves **163*b* to their center positions. The fluid pressure supplied to the thrust cylinders 174 is also terminated by returning the thrust valve 174*b* to its center position. The rear lift cylinders 84 are then extended to the bottom wall 18 of the trench to support the rear of the body assembly 27. With the trench cutting machine supported by the front lift cylinder 154 and by the two rear lift cylinders 84, the side support cylinders 66 are then retracted. This is accomplished by moving the valves 66*b* (FIG. 17) from their upward positions to their downward positions to supply fluid from the pump 66*a* to the rod side of the side support cylinders 66. To permit fast retraction of the side support cylinders 66, the rightward one of the cutter wheel valves 173*b* is moved from its center position to its rightward position so that fluid from the pump 163*a* associated with the rightward one of the cutter wheel valves 163*b* is combined with the fluid from the pump 66*a* to quickly retract the side support cylinders 66.**

Figure 20:
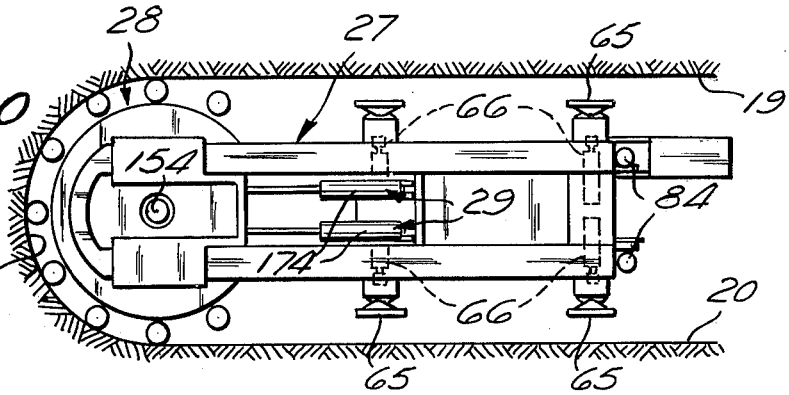
FIG. 20 is a schematic top plan view of the machine shown in FIG. 1 in a third position during a cutting cycle, with the cutter wheel extended and the side support feet retracted and the rear lift wheels extended.

When the side support cylinders 66 have been retracted, the trench cutting machine reaches a third position shown in FIG. 20. In this third position, flow of fluid to all of the hydraulic cylinders and motors is terminated by returning all of the control valves to the positions shown in FIG. 17. The thrust cylinders 174 are then retracted to pull the body assembly 27 longitudinally forwardly in the trench 11 while the cutter wheel assembly 28 remains stationary. This is accomplished by moving the thrust control valve **174*b* (FIG. 17) to its downward position to supply fluid from the thrust pump 174*a* to the rod side of the thrust cylinders 174. To provide fast retraction of the thrust cylinders 174 during this portion of the operation of the trench cutting machine, the leftward one of the cutter wheel control valves 163*b* shown in FIG. 17 is moved to its rightward position. This adds the output of the pump 163*a* associated with the leftward one of the cutter wheel control valves 163*b* to the output of the thrust pump 174*a* to provide increased flow to the rod side of the thrust cylinders 174 for fast retraction. After the thrust cylinders 174*b* have been retracted, the rear lift cylinders 84 and the front lift cylinders 154 are moved upwardly or downwardly as desired to properly position the machine vertically with respect to the bottom wall 18** of the trench.

Figure 21:
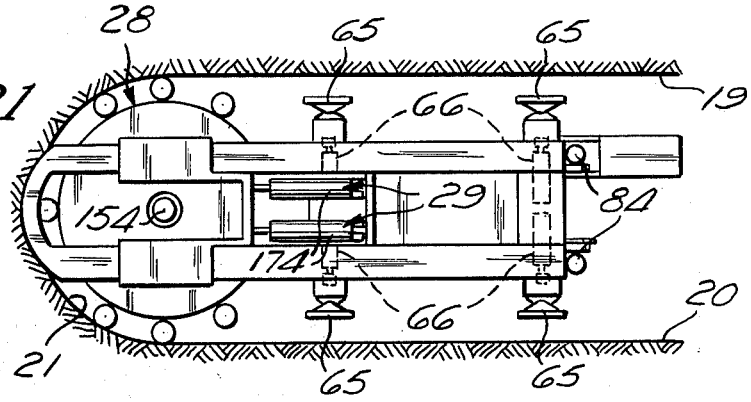
FIG. 21 is a schematic top plan view of the machine shown in FIG. 1 with the machine in a fourth position at the completion of a cutting cycle, with the main body assembly advanced up to the cutter wheel assembly and with the side support feet retracted and with the rear lift wheels extended.

This places the trench cutting machine in the fourth position shown in FIG. 21. In this fourth position, all of the control valves remain in their positions shown in FIG. 17 so that fluid flow is not supplied to any of the fluid motors or actuators. The side support valves **66*b* (FIG. 17) are then moved to their upward position to supply fluid pressure to the piston side of the support cylinders 66 to extend the side support cylinders 66. To increase the speed of extension of the side support cylinders 66, the rightward one of the cutter wheel control valves 163*b* is moved to its rightward position to add the output of its pump 163*a* to the fluid pressure supplied by the pump 66*a*. This provides rapid extension of the side support cylinders 66 until they engage the tunnel side walls 19 and 20.**

After the side support cylinders 66 firmly engage the side walls of the trench to secure the body assembly 27 of the trench cutting machine in place, the rear lift cylinders 84 are retracted. This is accomplished by moving the rear lift cylinders control valves **84*b* (FIG. 17) to their downward position to supply fluid pressure to the rod side of the cylinders 154 for retraction. This returns the trench cutting machine to its first position shown in FIG. 18** to begin another cycle of the machine.

What is claimed is:

1. A hard rock trench cutting machine for cutting a trench having an end wall, two opposed side walls, a bottom wall, an open top, a longitudinal axis extending parallel to said side walls and to said bottom wall, and a lateral axis extending between said side walls perpendicular to said longitudinal axis and parallel to said bottom wall; said machine comprising a main body assembly and a cutter wheel assembly and a longitudinal thrust assembly; said main body assembly including at least two laterally opposed side wall support feet, said feet being constructed and arranged to move laterally between a retracted position away from said side walls and an extended position engaging said side walls, said support feet including lateral thrust means for pushing said support feet against said side walls with a force sufficient to secure said main body assembly against longitudinal movement relative to said side walls; said cutter wheel assembly including a cutter wheel support frame carried by said main body assembly, said cutter wheel support frame being longitudinally movably disposed relative to said main body assembly, a cutter wheel drum rotatably carried by said cutter wheel support frame for rotation about a rotational axis relative to said cutter wheel support frame, said rotational axis being perpendicular to said lateral axis, said cutter wheel drum having a generally cylindrical outer peripheral surface, said outer peripheral surface extending substantially from said bottom wall of said trench to said open top of said trench, a plurality of individual cutters mounted on said outer peripheral surface for engaging said trench end face, said individual cutters extending along said trench end face continuously from said bottom wall to said open top, rotational drive means rotating said cutter wheel drum about said rotational axis relative to said cutter wheel support frame; said longitudinal thrust assembly including longitudinal thrust means extending between said main body assembly and said cutter wheel assembly moving said cutter wheel support frame longitudinally between a retracted position and an extended position relative to said main body assembly when said rotational drive means rotates said cutter wheel drum, said longitudinal thrust means being constructed and arranged to push said cutter means against said end face when said lateral thrust means pushes said feet against said side walls.

2. A hard rock trench cutting machine as set forth in claim 1, said cutter wheel support plate including mounting means mounting said cutter wheel support plate on said main body assembly for reciprocating movement solely in a direction parallel to said longitudinal axis.

3. A hard rock trench cutting machine as set forth in claim 2, said cutter wheel rotational axis being tilted longitudinally forwardly from a line extending vertically upwardly perpendicular to said longitudinal axis of said trench.

4. A hard rock trench cutting machine as set forth in claim 3, wherein said cutter wheel rotational axis and said line define an angle of less than 5 degrees.

5. A hard rock trench cutting machine as set forth in claim 1, said main body assembly including an electrically driven hydraulic pump, said rotational drive means being a hydraulic motor mounted on said cutter wheel support plate, and said pump on said main body assembly being constructed and arranged to provide fluid power to drive said motor on said cutter wheel assembly.

6. A hard rock trench cutting machine for cutting a trench having an end wall, two opposed side walls, a bottom wall, an open top, a longitudinal axis extending parallel to said side walls and to said bottom wall, and a lateral axis extending between said side walls perpendicular to said longitudinal axis and parallel to said bottom wall; said machine comprising a main body assembly and a cutter wheel assembly and a longitudinal thrust assembly; said main body assembly including at least two laterally opposed side wall support feet, said feet being constructed and arranged to move laterally between a retracted position away from said side walls and an extended position engaging said side walls, said support feet including lateral thrust means for pushing said support feet against said side walls with a force sufficient to secure said main body assembly against longitudinal movement relative to said side walls; said cutter wheel assembly including a cutter wheel support frame carried by said main body assembly, said cutter wheel support frame being longitudinally movably disposed relative to said main body assembly, a cutter wheel drum rotatably carried by said cutter wheel support frame for rotation about a rotational axis relative to said cutter wheel support frame, said rotational axis being perpendicular to said lateral axis, said cutter wheel drum having a generally cylindrical outer peripheral surface, said outer peripheral surface extending substantially from said bottom wall of said trench to said open top of said trench, a plurality of individual cutters mounted on said outer peripheral surface for engaging said trench end face, said individual cutters extending along said trench end face continuously from said bottom wall to said open top, rotational drive means rotating said cutter wheel drum about said rotational axis relative to said cutter wheel support frame; said longitudinal thrust assembly including longitudinal thrust means extending between said main body assembly and said cutter wheel assembly moving said cutter wheel support frame longitudinally between a retracted position and an extended position relative to said main body assembly when said rotational drive means rotates said cutter wheel drum, said longitudinal thrust means being constructed and arranged to push said cutter means against said end face when said lateral thrust means pushes said feet against said side walls, said cutter wheel drum being of circular longitudinal cross-sectional configuration, said circular configuration being separated into a center portion and two side portions by two substantially parallel longitudinally extending chords, one of said chords being disposed on each side of said rotational axis, said center portion being rotatably journaled on said cutter wheel support frame, and said side portions being removably mounted on said center portion.

7. A hard rock trench cutting machine for cutting a trench having an end wall, two opposed side walls, a bottom wall, an open top, a longitudinal axis, and a lateral axis; said machine comprising a main body assembly and a cutter wheel assembly and a longitudinal thrust assembly; said main body assembly including at least one longitudinally extending support boom, said boom having a forward portion and a rearward portion, at least two laterally opposed side wall support feet near said rearward portion of said boom, said feet being constructed and arranged to move laterally relative to said boom between a retracted position away from said side walls and an extended position engaging said side walls, said support feet including lateral thrust means for pushing said support feet against said side walls with a force sufficient to secure said boom against longitudinal movement relative to said side walls; said cutting wheel assembly including a cutter wheel support frame, mounting means movably mounting said cutter wheel support frame on said boom near said forward portion of said boom for longitudinal movement relative to said boom, a cutter wheel drum rotatably carried by said cutter wheel support frame for rotation about a rotational axis relative to said cutter wheel suppoort frame, said cutter wheel drum being disposed vertically beneath said support boom, said rotational axis being perpendicular to said lateral axis and being substantially vertical, said cutter wheel drum having a generally cylindrical outer peripheral surface, said outer peripheral surface extending substantially from said bottom wall of said trench to said open top of said trench, a plurality of individual roller cutters rotatably mounted on said outer peripheral surface for rotational movement relative to said outer peripheral surface and for engaging said trench end face, said individual roller cutters extending along said trench end face continuously from said bottom wall to said open top, rotational drive means for rotating said cutter wheel drum about said rotational axis relative to said cutter wheel support frame; said longitudinal thrust assembly including longitudinal thrust means extending between said main body assembly and said cutter wheel assembly for moving said cutter wheel support frame longitudinally between a retracted position and an extended position relative to said forward portion of said boom, said longitudinal thrust means being constructed and arranged to push said cutter means against said end face when said lateral thrust means pushes said feet against said side walls.

8. A hard rock trench cutting machine as set forth in claim 7, said boom being a cantilever boom with said rearward portion secured to said trench side walls by said support feet.

9. A hard rock trench cutting machine as set forth in claim 7, said boom being of generally rectangular lateral cross-sectional configuration.

10. A hard rock trench cutting machine as set forth in claim 7, said boom forward portion extending solely in a direction parallel to said longitudinal axis.

11. A hard rock trench cutting machine as set forth in claim 10, said cutter wheel rotational axis being tilted longitudinally forwardly from a line extending vertically upwardly perpendicular to said longitudinal axis of said trench, said cutter wheel rotational axis and said line defining an angle of less than 5°.

12. A hard rock trench cutting machine as set forth in claim 7, said main body assembly including at least one rear lift leg, said rear lift leg being constructed and arranged to move vertically relative to said boom between a retracted position away from said trench bottom wall and an extended position engaging said trench bottom wall.

13. A hard rock trench cutting machine as set forth in claim 7, said main body assembly including another support boom extending parallel to said first mentioned boom and having a forward and a rearward portion, said rearward portion being rigidly secured to said rearward portion of said first mentioned boom, and said cutter wheel support frame being longitudinally movably disposed relative to said other boom.

14. A hard rock trench cutting machine for cutting a trench having an end wall, two opposed side walls, a bottom wall, an open top, a longitudinal axis extending parallel to said side walls and to said bottom wall, and a lateral axis extending between said side walls perpendicular to said longitudinal axis and parallel to said bottom wall; said machine comprising a main body assembly and a cutter wheel assembly and a longitudinal thrust assembly; said main body assembly incuding two longitudinally extending support booms, said booms each having a forward portion and a rearward portion, means rigidly connecting said rearward portions to one another, at least two laterally opposed side wall support feet near said rearward portion of said booms, said feet being constructed and arranged to move laterally relative to said booms between a retracted position away from said side walls and an extended position engaging said side walls, said support feet including lateral thrust means pushing said support feet against said side walls with a force sufficient to secure said booms against longitudinal movement relative to said side walls; said cutter wheel assembly including a cutter wheel support frame carried by said booms near said forward portion of said booms, said cutter wheel support frame being longitudinally slidably disposed on said booms, a cutter wheel drum rotatably carried by said cutter wheel support frame for rotation about a rotational axis relative to said cutter wheel support frame, said rotational axis being disposed in a plane which is perpendicular to said lateral axis and in which said longitudinal axis is disposed, said cutter wheel drum carrying a plurality of cutter means engaging said trench end face, rotational drive means rotating said cutter wheel drum about said rotational axis relative to said cutter wheel support frame; said longitudinal thrust assembly including longitudinal thrust means extending between said main body assembly and said cutter wheel assembly moving said cutter wheel support frame longitudinally between a retracted position and an extended position relative to said forward portion of said booms, said longitudinal thrust means being constructed and arranged to push said cutter means against said end face when said lateral thrust means pushes said feet against said side walls.

15. A hard rock trench cutting machine as set forth in claim 14, said booms being cantilever booms with said rearward portions secured to said trench side walls by said support feet, said forward portions of said booms each terminating at a free end, said main body assembly including a connector beam extending between and rigidly connecting said free ends of said booms.

16. A hard rock trench cutting machine as set forth in claim 14, said booms being rigidly connected to said side support feet, said side support feet being disposed vertically below said trench open top, and said forward portion of each of said booms being disposed vertically above said trench open top.

17. A hard rock trench cutting machine as set forth in claim 14, said forward portion of each of said booms extending solely in a direction parallel to said longitudinal axis, said cutter wheel rotational axis being tilted longitudinally forwardly from a line extending vertically upwardly perpendicular to said longitudinal axis of said trench, said cutter wheel rotational axis and said line defining an angle less than 5°.

18. A hard rock trench cutting machine as set forth in claim 14, said cutter wheel support frame including a sleeve member slidably disposed on said forward portion of each of said booms.

19. A hard rock trench cutting machine as set forth in claim 14, said main body assembly including an electrically driven hydraulic pump, said rotational drive means being a hydraulic motor mounted on said cutter wheel support plate, and said pump on said main body assembly being constructed and arranged to provide fluid power to drive said motor on said cutter wheel assembly.

20. A hard rock trench cutting machine for cutting a trench having an end wall, two opposed side walls, a bottom wall, an open top, a longitudinal axis extending parallel to said side walls and to said bottom wall, and a lateral axis extending between said side walls perpendicular to said longitudinal axis and parallel to said bottom wall; said machine comprising a main body assembly and a cutter wheel assembly and a longitudinal thrust assembly; said main body assembly including two longitudinally extending support booms, said booms each having a forward portion and a rearward portion, means rigidly connecting said rearward portions to one another, at least two laterally opposed side wall support feet near said rearward portion of said booms, said feet being constructed and arranged to move laterally relative to said booms between a retracted position away from said side walls and an extended position engaging said side walls, said support feet including lateral thrust means pushing said support feet against said side walls with a force sufficient to secure said booms against longitudinal movement relative to said side walls; said cutter wheel assembly including a cutter wheel support frame carried by said booms near said forward portion of said booms, said cutter wheel support frame being longitudinally slidably disposed on said booms, a cutter wheel drum rotatably carried by said cutter wheel support frame for rotation about a rotational axis relative to said cutter wheel support frame, said rotational axis being disposed in a plane which is perpendicular to said lateral axis and in which said longitudinal axis is disposed, said cutter wheel drum carrying a plurality of cutter means engaging said trench end face, rotational drive means rotating said cutter wheel drum about said rotational axis relative to said cutter wheel support frame; said longitudinal thrust assembly including longitudinal thrust means extending between said main body assembly and said cutter wheel assembly moving said cutter wheel support frame longitudinally between a retracted position and an extended position relative to said forward portion of said booms, said longitudinal thrust means being constructed and arranged to push said cutter means against said end face when said lateral thrust means pushes said feet against said side walls, said cutter wheel drum being of circular longitudinal cross-sectional configuration, said circular configuration being separated into a center portion and two side portions by two substantially parallel longitudinally extending chords, one of said chords being disposed on each side of said rotational axis, said center portion being rotatably journaled on said cutter wheel support frame, and said side portions each being removably mounted on said center portion.

21. A hard rock trench cutting machine as set forth in claim 20, said support feet being removably mounted on said main body assembly.

22. A hard rock trench cutting machine for cutting a trench having an end wall, two opposed side walls, a bottom wall, an open top, a longitudinal axis extending parallel to said side walls and to said bottom wall, and a lateral axis extending between said side walls perpendicular to said longitudinal axis and parallel to said bottom wall; said machine comprising a main body assembly and a cutter wheel assembly and a longitudinal thrust assembly; said main body assembly incuding two pairs of laterally opposed side wall support feet, said two pair being longitudinally spaced apart from one another, each of said pairs including a box like support of generally rectangular longitudinal cross-sectional configuration extending laterally across said main frame assembly, two opposed laterally movable support feet slidably disposed in each of said supports for movement between a retracted position away from said side walls and an extended position engaging said side walls, each of said pairs including lateral thrust means for pushing its support feet against said side walls with a force sufficient to secure said main body assembly against longitudinal movement relative to said side walls, two longitudinally extending support booms, said booms each having a forward portion and a rearward portion, each of said supports being rigidly secured to each of said boom rearward portions vertically beneath said boom rearward portions, said booms each being disposed vertically above said open top of said trench and said supports each being disposed vertically beneath said open top of said trench, two rear lift legs near said rearward portion of said booms, said rear lift legs being constructed and arranged to move vertically relative to said booms between a retracted position away from said tench bottom wall and an extended position engaging said trench bottom wall; said cutter wheel assembly including a cutter wheel support frame slidably carried on said forward portion of said booms, a cutter wheel drum rotatably carried by said cutter wheel support frame for rotation about an axis relative to said cutter wheel support frame, said cutter wheel drum carrying a plurality of cutter means engaging said trench end face, rotational drive means rotating said cutter wheel drum relative to said cutter wheel support frame, a front lift leg mounted on said cutter wheel support frame, said front lift leg being constructed and arranged to move vertically relative to said cutter wheel support frame; said longitudinal thrust assembly including longitudinal thrust means extending between said main body assembly and said cutter wheel assembly moving said cutter wheel support frame longitudinally between a retracted position and an extended position relative to said forward portion of said booms, said longitudinal thrust means being constructed and arranged to push said cutter means against said end face when said lateral thrust means pushes said feet against said side walls.

23. A hard rock trench cutting machine for cutting a path havig an end wall and side walls, said machine comprising a main body assembly and a cutter assembly and a longitudinal thrust assembly and a fluid power circuit; said main body assembly including at least two laterally opposed side wall support feet, a support foot fluid motor associated with each support foot constructed and arranged to move said support foot laterally between a retracted position away from said side walls and an extended position engaging said side walls with a force sufficient to secure said main body assembly against longitudinal movement relative to said side walls; said cutter assembly including a cutter carrier member, a plurality of cutter means secured to said cutter carrier member engaging said end face, a cutter fluid motor rotating said cutter carrier member when said support feet are in their extended position; said longitudinal thrust assembly including a thrust fluid motor acting between said main body assembly and said cutter assembly, said thrust fluid motor being constructed and arranged to push said cutter means against said end face when said support feet are in their extended position and to pull said main body assembly longitudinally toward said cutter assembly when said support feet are in their retracted position; and said fluid power circuit including a side support fluid pump, side support valve means opening and closing fluid pressure communication between said side support fluid pump and said side support fluid motors, at least one cutter fluid pump, cutter valve means opening and closing fluid pressure communication between said cutter fluid pump and said cutter fluid motor, a thrust fluid pump, thrust valve means opening and closing fluid pressure communication between said thrust fluid pump and said thrust fluid motor, and adding valve means opening and closing fluid pressure communication between said cutter fluid pump and said thrust fluid motor when said cutter valve means is closed and said side support feet are retracted and said thrust fluid motor is pulling said main body assembly longitudinally toward said cutter assembly.

24. A hard rock trench cutting machine as set forth in claim 23, said fluid power circuit including another cutter fluid pump, said cutter valve means opening and closing fluid pressure communication between said other cutter fluid pump and said cutter fluid motor, and another adding valve means opening and closing fluid pressure communication between said other cutter pump and said support foot motors when said cutter valve means is closed.

* * * * *